US007918532B2

(12) United States Patent
Shimazaki

(10) Patent No.: US 7,918,532 B2
(45) Date of Patent: Apr. 5, 2011

(54) FLUID EJECTING APPARATUS

(75) Inventor: Jun Shimazaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 195 days.

(21) Appl. No.: 12/184,366

(22) Filed: Aug. 1, 2008

(65) Prior Publication Data

US 2009/0033707 A1 Feb. 5, 2009

(30) Foreign Application Priority Data

Aug. 2, 2007 (JP) ..... 2007-201660

(51) Int. Cl.
*B41J 2/165* (2006.01)

(52) U.S. Cl. ..... 347/29

(58) Field of Classification Search ..... None
See application file for complete search history.

(56) References Cited

U.S. PATENT DOCUMENTS 5,610,640 A * 3/1997 Anderson et al. ..... 347/32
2008/0136863 A1* 6/2008 Yoshino et al. ..... 347/29

FOREIGN PATENT DOCUMENTS

JP 07-025026 1/1995
JP 2003-154681 5/2003
JP 2003-334962 11/2003

* cited by examiner

*Primary Examiner* — Matthew Luu
*Assistant Examiner* — Alejandro Valencia
(74) *Attorney, Agent, or Firm* — Workman Nydegger

(57) ABSTRACT

A fluid ejecting apparatus for ejecting fluid includes a head capable of performing effective discharge during which the fluid is discharged to an object to be processed disposed at a predetermined position and capable of preliminary discharge during which the fluid is discharged separately from the effective discharge, a first head capping unit for preliminary discharge covering the head and receiving the fluid discharged from the head while the head performs the preliminary discharge, and a second head capping unit for moisturizing covering the head and moisturizing the head. The first head capping unit and the second head capping unit are stacked in such a manner that the second head capping unit covers both the head and an opening of the first head capping unit for receiving the fluid while the head does not perform either the effective discharge or the preliminary discharge.

5 Claims, 8 Drawing Sheets

<DURING POWER-OFF>

<DURING PRINTING>

<DURING SUCTION RECOVERY>

<DURING FLUSHING>

FLUID EJECTING APPARATUS

BACKGROUND

1. Technical Field

The present invention relates to technology to prevent clogging of nozzles in fluid ejecting apparatuses that eject fluid.

2. Related Art

In ink-jet recording apparatuses, which discharge ink to, for example, recording sheets through nozzles, clogging of nozzles and ink-discharge failure resulting therefrom may occur due to thicker ink in the vicinity of the nozzles or bubbles entering the nozzles. To solve this, JP-A-2003-334962 proposes an ink-jet recording apparatus that removes bubbles and thicker ink remaining in nozzles by suction (hereinafter, referred to as "suction recovery") by covering a discharge surface of a head with a dedicated cap and by forming a negative pressure inside the cap.

The dedicated cap includes an adhesion member to which ink and the like adhere. Thicker ink and the like sucked from the nozzles and discharged inside the dedicated cap adhere to the adhesion member. Herein, when the ink-jet recording apparatus capable of suction recovery does not perform suction recovery (e.g., during printing and during power-off), the dedicated cap is open. Therefore, the thicker ink adhering to the adhesion member inside the dedicated cap is dried, and may cause clogging of the adhesion member. This may reduce ink-adhesion capacity of the dedicated cap, and may reduce suction force of the nozzles.

This problem may occur not only in the dedicated cap for suction recovery but also in, for example, caps used for so-called flushing during which a predetermined amount of ink is discharged from all the nozzles such that thicker ink and the like are removed. That is, this problem may occur in caps used for discharging ink from nozzles separately from printing (hereinafter, referred to as "preliminary discharge"). Moreover, this problem may occur not only in ink-jet recording apparatuses but also in fluid ejecting apparatuses that eject fluid (including liquid, liquid bodies in which particles of functional materials are dispersed, and solids such as fine particles capable of being ejected as fluid) other than ink.

SUMMARY

An advantage of some aspects of the invention is that a technology of preventing fluid discharged inside a head cap for preliminary discharge from drying in a fluid ejecting apparatus is provided.

The invention can be carried out in the following modes or application examples.

APPLICATION EXAMPLE 1

A fluid ejecting apparatus for ejecting fluid includes a head capable of performing effective discharge during which the fluid is discharged to an object to be processed disposed at a predetermined position and capable of preliminary discharge during which the fluid is discharged separately from the effective discharge, a first head capping unit for preliminary discharge covering the head and receiving the fluid discharged from the head while the head performs the preliminary discharge, and a second head capping unit for moisturizing covering the head and moisturizing the head. The first head capping unit and the second head capping unit are stacked in such a manner that the second head capping unit covers both the head and an opening of the first head capping unit for receiving the fluid while the head does not perform either the effective discharge or the preliminary discharge.

In the fluid ejecting apparatus in Application Example 1, the second head capping unit covers both the head and the opening of the first head capping unit while the head does not perform either the effective discharge or the preliminary discharge. Thus, the head and the fluid discharged inside the first head capping unit during the preliminary discharge can be prevented from drying. Moreover, the second head capping unit for preventing the head from drying is also used for preventing the interior of the first head capping unit from drying. Thus, an increase in the cost of producing the fluid ejecting apparatus can be prevented.

APPLICATION EXAMPLE 2

The fluid ejecting apparatus in Application Example 1 is characterized in that the first head capping unit and the second head capping unit are disposed in such a manner that the opening of the first head capping unit is covered by the second head capping unit while the head performs the effective discharge.

With this, the opening of the first head capping unit is covered by the second head capping unit even when the head performs the effective discharge. Thus, the fluid discharged inside the first head capping unit can be prevented from drying during the effective discharge.

APPLICATION EXAMPLE 3

The fluid ejecting apparatus in Application Example 1 is characterized in that the head discharges the fluid downward while the head performs the effective discharge and the preliminary discharge; the opening of the first head capping unit faces upward; and the second head capping unit covers the head from the bottom of the head, and the first head capping unit is disposed under the second head capping unit and is in contact with the bottom surface of the second head capping unit in such a manner that the opening is covered by the bottom surface while the first head capping unit and the second head capping unit are stacked.

Since the second head capping unit covers the head from the bottom of the head, the head can be prevented from drying. Moreover, since the first head capping unit is disposed under the second head capping unit and is in contact with the bottom surface of the second head capping unit in such a manner that the opening is covered by the bottom surface, the fluid discharged inside the first head capping unit can be prevented from drying.

APPLICATION EXAMPLE 4

The fluid ejecting apparatus in Application Example 1 further includes a humidifier, and is characterized in that the humidifier humidifies at least one of a first space formed when the second head capping unit covers the head and a second space formed when the second head capping unit covers the opening of the first head capping unit.

With this, the discharged fluid in the space(s) to be humidified among the first space and the second space can be prevented from drying compared with the case where both spaces are not humidified.

APPLICATION EXAMPLE 5

The fluid ejecting apparatus in Application Example 1 is characterized in that the fluid is liquid.

With this, the fluid discharged inside the first head capping unit during the preliminary discharge can be prevented from thickening or solidifying due to drying.

BRIEF DESCRIPTION OF THE DRAWINGS

The invention will be described with reference to the accompanying drawings, wherein like numbers reference like elements.

DESCRIPTION OF EXEMPLARY EMBODIMENTS

Best modes for carrying out the invention will now be described on the basis of examples in the following order:

EXAMPLE 1
EXAMPLE 2
MODIFICATIONS

EXAMPLE 1

Figure 1:
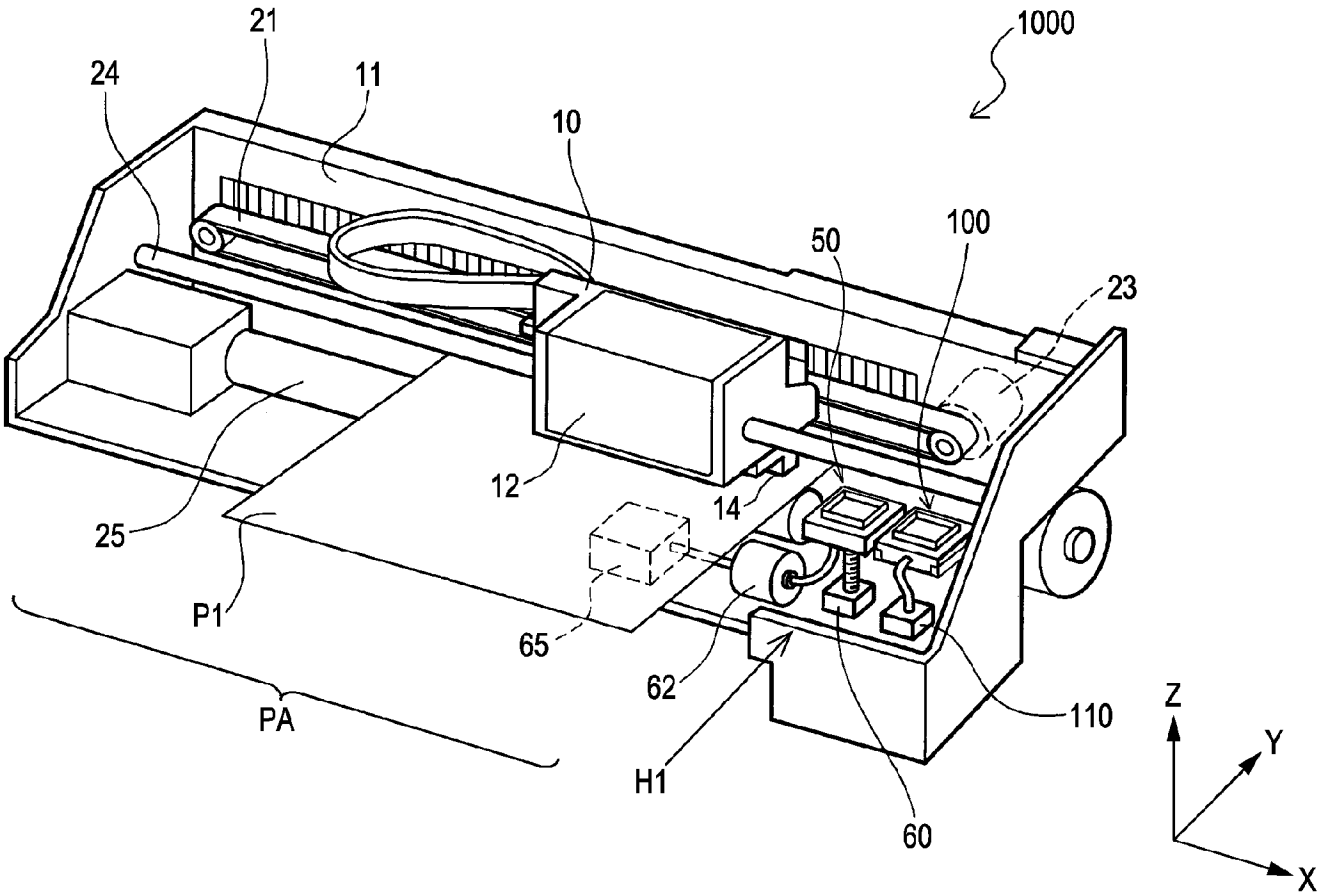
FIG. 1 schematically illustrates the structure of an ink-jet printer serving as a fluid ejecting apparatus in Example 1 of the invention.

FIG. 1 schematically illustrates the structure of an ink-jet printer serving as a fluid ejecting apparatus in Example 1 of the invention. A printer 1000 includes a frame 11 in which a platen 25 is disposed. A recording sheet P1 is fed on the platen 25 by a paper feeding mechanism (not shown). The printer 1000 further includes a carriage 10 supported by the frame 11 using a guide member 24 so as to be movable in the longitudinal direction (X-axis direction) of the platen 25. The carriage 10 is reciprocated by a carriage motor 23 via a timing belt 21.

The carriage 10 has an ink cartridge 12 installed therein. Moreover, an ink-jet recording head (hereinafter, simply referred to as "head") 14 is disposed at a lower portion of the carriage 10. The head 14 discharges fluid such as ink to the recording sheet P1. Specifically, the head 14 includes nozzles (not shown) from which ink droplets are discharged by expansion and contraction of piezoelectric vibrators such as piezoelectric elements. A large number of nozzle holes (not shown) are formed in the bottom surface (discharge surface) of the head 14. Printing is performed when ink is discharged from the head 14 to the recording sheet P1 by the piezoelectric vibrators expanding and contracting on the basis of print data while the carriage 10 moves along the platen 25. Herein, printing corresponds to effective discharge described in the claims. In addition to the printing, the printer 1000 performs suction recovery for removing bubbles and thicker ink remaining in the nozzles.

In the frame 11, a non-printing area where printing is not performed is defined at a side of an area (hereinafter, referred to as "printing area") PA where printing is performed by the head 14, and a home position H1 is defined inside the non-printing area. The carriage 10 moves between the printing area PA and the home position H1 along the platen 25.

A first capping device 50 for suction recovery and a lifting device 60 are disposed at the home position H1. A suction pump 62 and a waste-ink tank 65 connected to the suction pump 62 are disposed at the left of the home position H1. A second capping device 100 for moisturizing and a humidifier 110 are disposed at the right of the home position H1.

Figure 2:
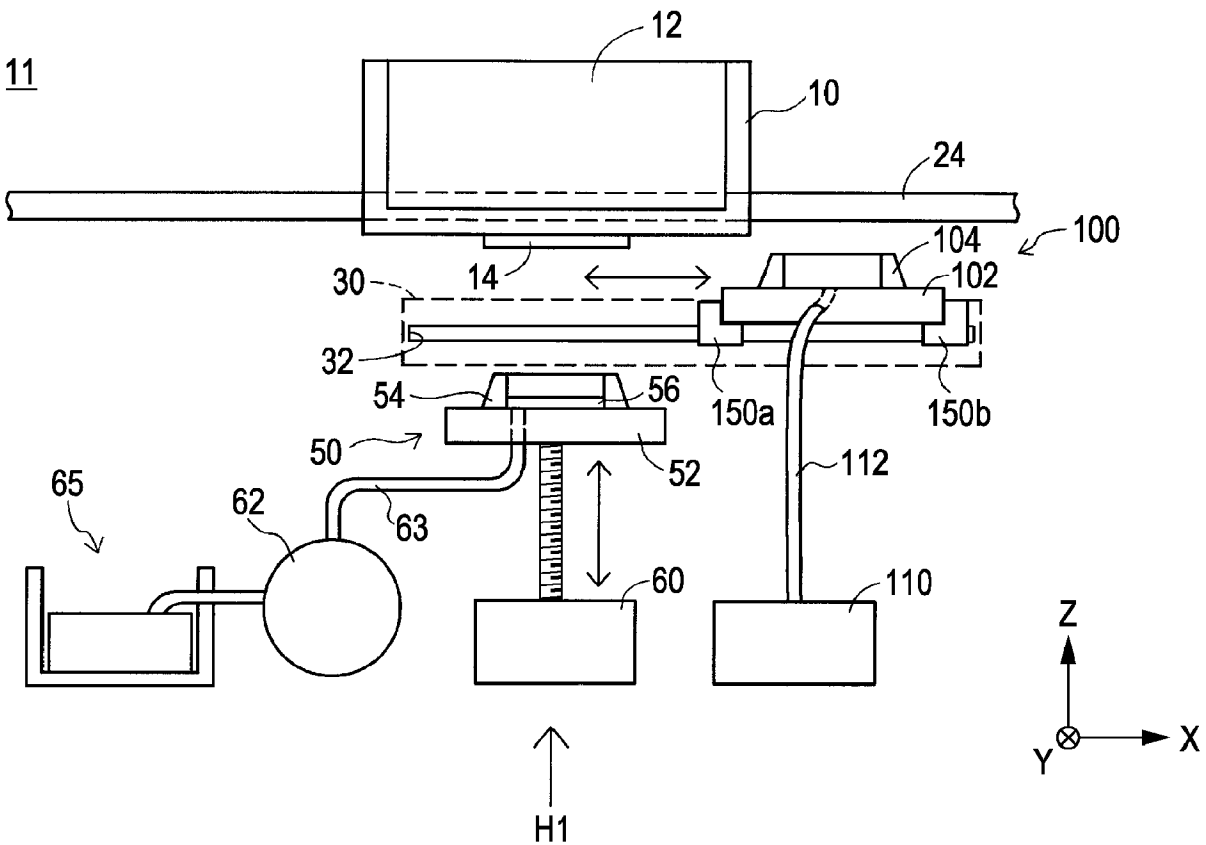
FIG. 2 illustrates a detailed structure in the vicinity of a home position H1.

FIG. 2 illustrates a detailed structure in the vicinity of the home position H1. In FIG. 2, the carriage 10 is disposed at the home position H1. The first capping device 50 is a dedicated capping device for covering the head 14 (nozzle holes (not shown) in the discharge surface) during suction recovery. The first capping device 50 includes a cap holder 52, a cap portion 54 disposed on the cap holder 52 and protruding in a Z-axis direction, and a sheet sponge 56 disposed on the bottom of a space enclosed by the cap portion 54. The sponge 56 is connected to the suction pump 62 via the cap holder 52 and a tube 63. The first capping device 50 is installed in the frame 11 so as to be vertically movable using the lifting device 60. Well-known lifting mechanisms such as those in which motors and screws are combined can be used as the lifting device 60.

Ink discharged from the head 14 during suction recovery adheres to the sponge 56 included in the first capping device 50. During suction recovery, the suction pump 62 forms a negative pressure inside the cap portion 54 by reducing the pressure inside the cap portion 54. With this, remaining ink is discharged from the nozzles (not shown) in the head 14, and the discharged ink is sucked via the sponge 56 and the tube 63 and is discharged to the waste-ink tank 65.

The second capping device 100 includes a cap holder 102 and a cap portion 104 disposed on the cap holder 102 and protruding in the Z-axis direction. The cap holder 102 is connected to the humidifier 110 via a tube 112. The humidifier 110 includes a water tank and a heater (not shown), and can humidify a space enclosed by the cap portion 104 via the tube 112 and the cap holder 102. The second capping device 100 is supported by two supporting members 150*a* and 150*b* from the bottom thereof. These two supporting members 150*a* and 150*b* are disposed so as to be reciprocable in the horizontal direction (X-axis direction) along a long hole 32 formed in the frame 11 and extending in the X-axis direction. The leftmost position of the second capping device 100 can be the home position H1. A moving mechanism 30 for reciprocating the supporting members 150*a* and 150*b* in the X-axis direction is disposed at the back of the long hole 32 (outside the frame 11). The moving mechanism 30 moves the second capping device 100 in the X-axis direction by driving the supporting members 150*a* and 150*b* in the X-axis direction.

Figure 3:
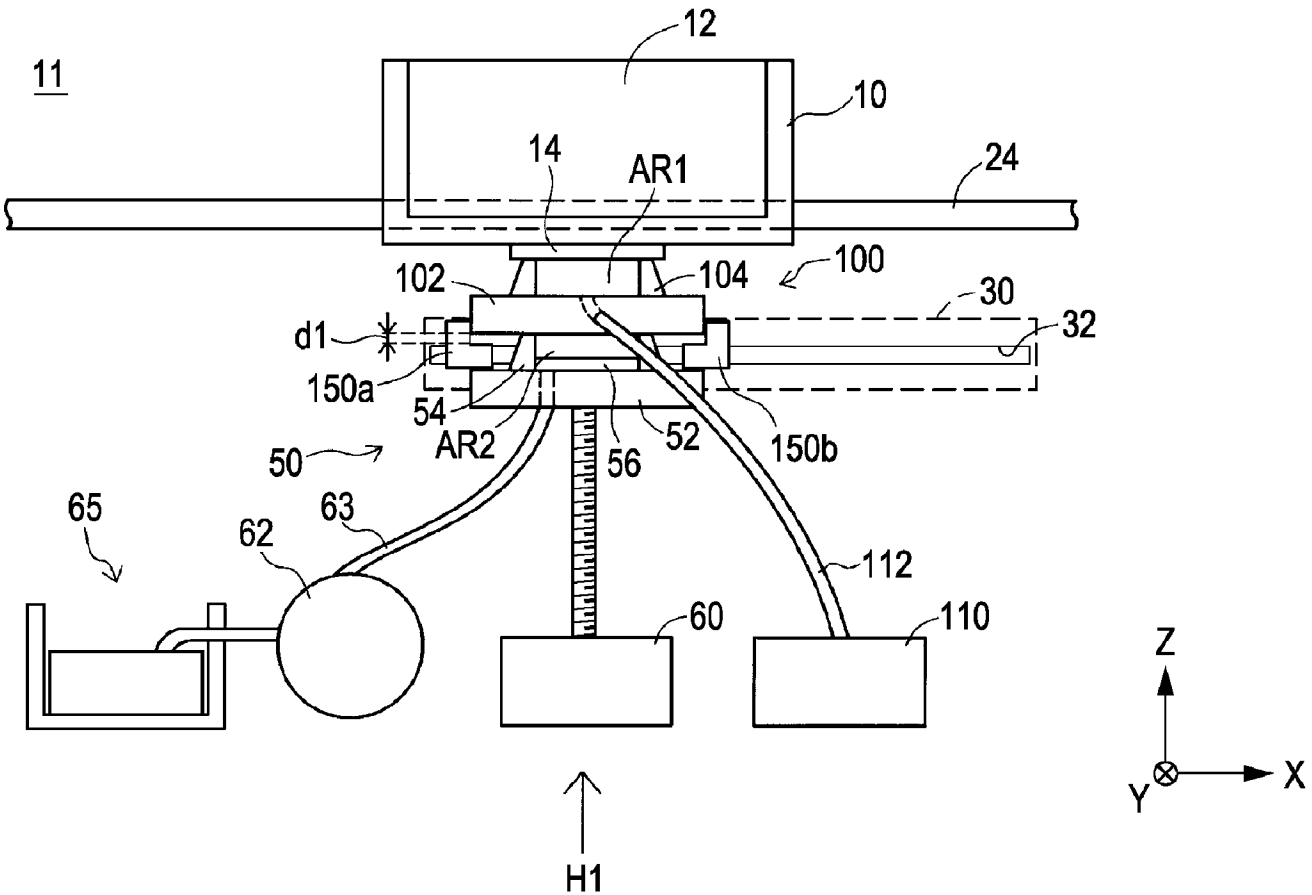
FIG. 3 illustrates a detailed structure in the vicinity of the home position H1 during power-off.

FIG. 3 illustrates a detailed structure in the vicinity of the home position H1 during power-off. The carriage 10 is disposed at the home position H1 when the printer 1000 is turned off. Similarly, the second capping device 100 and the first capping device 50 are also disposed at the home position H1. The second capping device 100 is in contact with the head 14 at the cap portion 104, and covers a part (area in which the nozzle holes (not shown) are formed) of the discharge surface of the head 14. With this, a substantially sealed space AR1 enclosed by the cap portion 104 and the head 14 is formed.

Moreover, the second capping device 100 is in contact with the cap portion 54 of the first capping device 50 at the bottom surface of the cap holder 102, and covers the opening of the cap portion 54. With this, a substantially sealed space AR2 enclosed by the cap portion 54 and the bottom surface of the cap holder 102 is formed.

The head 14, the second capping device 100, and the first capping device 50 are disposed in this manner while the printer 1000 is turned on the last time as follows. First, the carriage 10 is disposed at the home position H1. Subsequently, the second capping device 100 is disposed at the home position H1 by the moving mechanism 30. Next, the first capping device 50 is lifted by the lifting device 60 at the home position H1, and the cap portion 54 is brought into contact with the bottom surface of the cap holder 102 of the second capping device 100. The first capping device 50 continues to rise even after the cap portion 54 is brought into contact with the bottom surface of the cap holder 102. With this, the second capping device 100 is pushed up by the first capping device 50 from the bottom thereof, and is lifted from the supporting members 150*a* and 150*b* so as to be brought into contact with the head 14 as shown in FIG. 3. At this moment, the second capping device 100 is disposed above (+Z direction) supporting surfaces of the supporting members 150*a* and 150*b* by a length d1.

Since the substantially sealed space AR2 is formed in the first capping device 50 as described above, ink remaining in the sponge 56 disposed inside the space AR2 can be prevented from drying. Therefore, clogging of the sponge 56 caused by the remaining ink thickened due to drying can be prevented. Herein, "ink remaining in the sponge 56" refers to ink sucked from the nozzles (not shown) during suction recovery and remaining in the sponge without being discharged to the waste-ink tank 65. Moreover, since the substantially sealed space AR1 is formed in the second capping device 100, ink remaining in the nozzle holes located inside the space AR1 can be prevented from drying. Moreover, since the space AR1 is humidified by the humidifier 110, the head 14 is prevented from drying, and thus discharge failure at the nozzles and so-called cap marks (ink droplets remaining along contact portions with the cap portion 54) formed on the discharge surface of the head 14 can be prevented. Moreover, since the bottom surface of the cap holder 102 of the second capping device 100 is used for preventing the interior of the first capping device 50 from drying, the number of parts can be reduced compared with the case where a dedicated cap for preventing drying is used. With this, an increase in the cost of producing the printer 1000 can be prevented. Herein, the space AR1 corresponds to a first space described in the claims, and the space AR2 corresponds to a second space described in the claims. Moreover, the first capping device 50 corresponds to a first head capping unit for preliminary discharge described in the claims.

Figure 4:
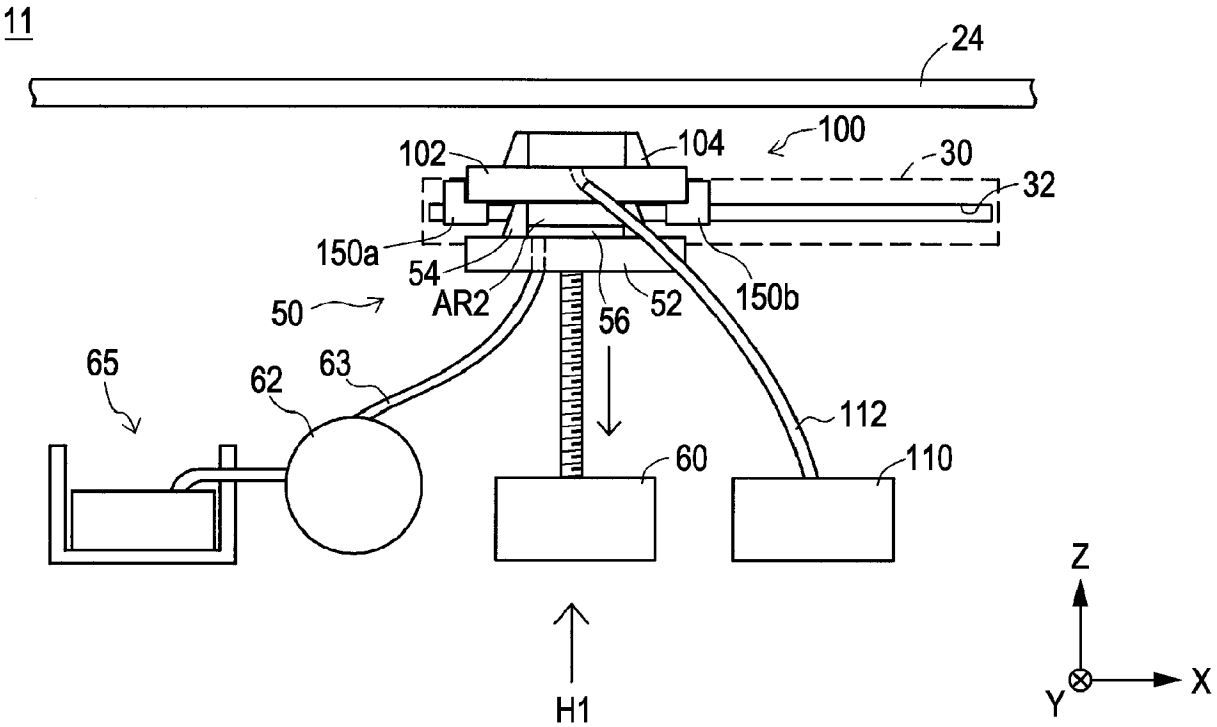
FIG. 4 illustrates a detailed structure in the vicinity of the home position H1 during printing.

FIG. 4 illustrates a detailed structure in the vicinity of the home position H1 during printing. The carriage 10, the second capping device 100, and the first capping device 50 are disposed as shown in FIG. 3 even after the printer 1000 is turned on until printing is started. When print data is sent from, for example, a personal computer (not shown) to the printer 1000 and printing is started, the lifting device 60 lowers the first capping device 50. With this, the second capping device 100, which was pushed up by the first capping device 50, is also lowered. When the second capping device 100 is lowered to a position where the second capping device 100 is supported by the supporting members 150*a* and 150*b*, the lifting device 60 stops lowering the first capping device 50. Subsequently, the carriage 10 moves from the home position H1 to the left, and is disposed in the printing area PA (see FIG. 1). At this moment, ink droplets adhering to the bottom surface of the head 14 (see FIG. 1) can be wiped off by a blade (not shown). The carriage 10 disposed in the printing area PA performs printing on the basis of the received print data.

The cap portion 54 of the first capping device 50 is kept in contact with the bottom surface of the cap holder 102 of the second capping device 100 while the first capping device 50 and the second capping device 100 are lowered. Therefore, the substantially sealed space AR2 is formed in the first capping device 50 also during printing. Thus, ink remaining in the sponge 56 is not dried, and clogging of the sponge 56 can be prevented.

After completion of printing, the carriage 10, the second capping device 100, and the first capping device 50 are returned to the positions shown in FIG. 3. With this, the head 14 and the interior of the first capping device 50 are prevented from drying during a standby mode for printing.

Figure 5:
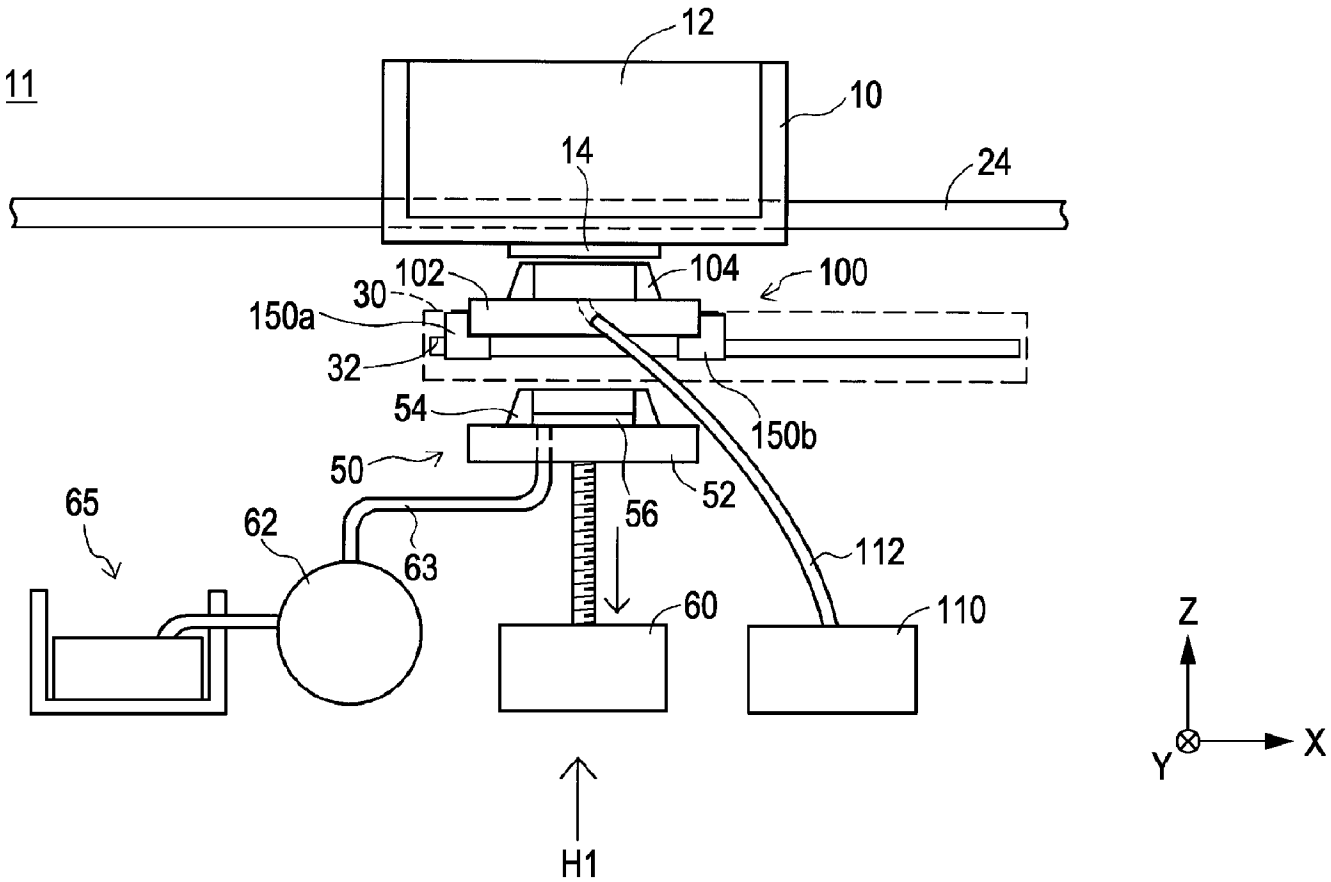
FIG. 5 illustrates a detailed structure in the vicinity of the home position H1 during transition to suction recovery from the state shown in FIG. 3.

FIG. 5 illustrates a detailed structure in the vicinity of the home position H1 during transition to suction recovery from the state shown in FIG. 3. When the printer 1000 in a standby mode for printing (see FIG. 3) receives an instruction to perform suction recovery, the lifting device 60 lowers the first capping device 50. At this moment, unlike the case where printing is performed, the lifting device 60 lowers the first capping device 50 by a predetermined distance even after the second capping device 100 is lowered to the position where the second capping device 100 is supported by the supporting members 150*a* and 150*b*. With this, the second capping device 100 is no longer in contact with the head 14 at the cap portion 104, and stops descending since the second capping device 100 is supported by the supporting members 150*a* and 150*b*. On the other hand, the first capping device 50 is no longer in contact with the bottom surface of the second capping device 100 at the cap portion 54, and is disposed at a lower position separated from the second capping device 100.

Figure 6:
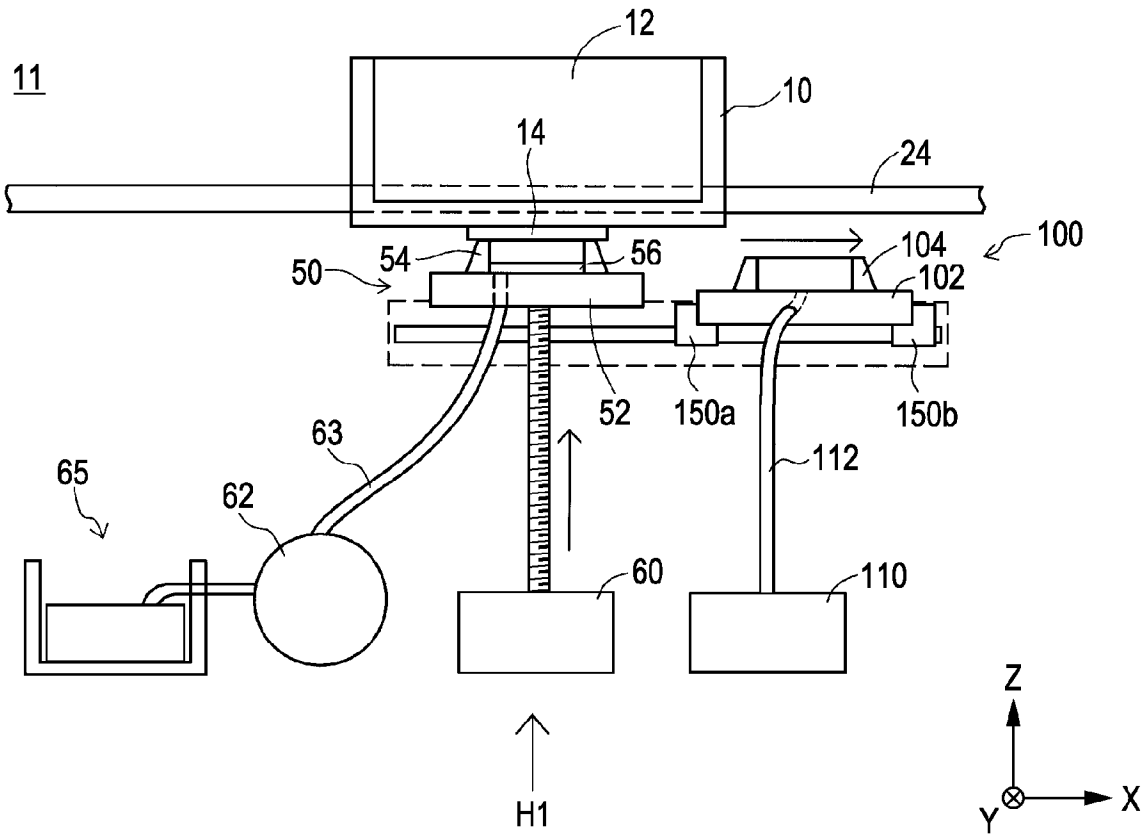
FIG. 6 illustrates a detailed structure in the vicinity of the home position H1 during suction recovery.

FIG. 6 illustrates a detailed structure in the vicinity of the home position H1 during suction recovery. After the components are disposed as shown in FIG. 5, the second capping device 100 moves to the right and is disposed as shown in FIG. 2. Subsequently, the first capping device 50 is lifted from the position shown in FIG. 2 by the lifting device 60, and is brought into contact with the head 14 at the cap portion 54 as shown in FIG. 6. In this state, the suction pump 62 starts sucking so as to form a negative pressure inside the cap portion 54, and sucks ink from the nozzles (not shown) in the head 14. Since the second capping device 100 moves aside before suction recovery is performed as described above, the first capping device 50 can be brought into contact with the head 14 without any obstruction while being lifted.

After completion of suction recovery, the carriage 10, the second capping device 100, and the first capping device 50 are returned to the positions shown in FIG. 3. With this, the head 14 and the interior of the first capping device 50 are prevented from drying during the standby mode for printing.

As described above, the head 14, the second capping device 100, and the first capping device 50 are stacked in this order in the printer 1000 during power-off. With this arrangement, the second capping device 100 covers the discharge surface of the head 14, and at the same time, covers the opening of the cap portion 54 of the first capping device 50 using the bottom surface thereof. Thus, the nozzles in the head 14 and ink remaining in the sponge 56 inside the first capping device 50 are prevented from drying, and clogging of the sponge 56 can be prevented. Moreover, since the second capping device 100 covers the opening of the cap portion 54 using the bottom surface thereof also during printing, ink remaining in the sponge 56 is prevented from drying, and clogging of the sponge 56 can be prevented.

EXAMPLE 2

Figure 7:
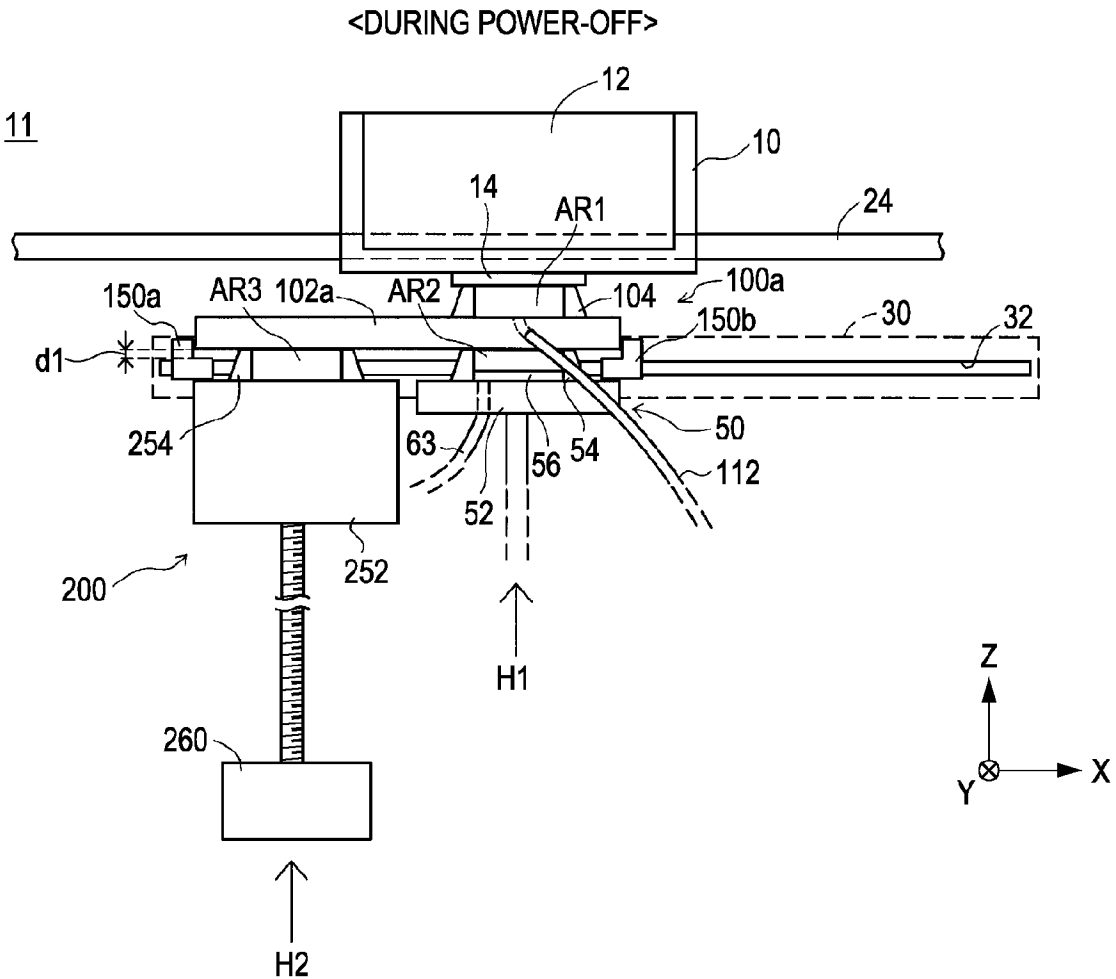
FIG. 7 illustrates a detailed structure in the vicinity of the home position H1 during power-off of a printer in Example 2.

FIG. 7 illustrates a detailed structure in the vicinity of the home position H1 during power-off of a printer in Example 2. The printer in Example 2 differs from the printer 1000 (see FIG. 1) in the following four points. That is, the printer performs flushing as a preliminary discharge in addition to suction recovery, includes a flushing box 200, includes a third capping device 100*a* for moisturizing with a relatively large cap holder 102*a* instead of the second capping device 100, and allows the third capping device 100*a* to move in a relatively wide range in the X-axis direction. Structures other than these are the same as those in Example 1.

The flushing box 200 is disposed at a flushing position H2 located at the left of the home position H1. The flushing box 200 receives ink discharged from all the nozzles (not shown) in the head 14 while the printer 1000 performs flushing. The flushing box 200 includes a cap portion 254 that is in contact with the head 14 and covers the nozzle holes (not shown) during flushing and a tank 252 that stores ink received during flushing. The flushing box 200 is installed in the frame 11 so as to be vertically movable by a lifting device 260 as is the first capping device 50. In this example, the first capping device 50 and the flushing box 200 correspond to the first head capping unit for preliminary discharge described in the claims.

The carriage 10, the third capping device 100*a*, and the first capping device 50 are disposed in a manner similar to those in Example 1 (see FIG. 3) when the printer 1000 in Example 2 is turned off. Therefore, the head 14 and the interior of the first capping device 50 (cap portion 54) are prevented from drying. Herein, the cap holder 102*a* of the third capping device 100*a* extends in the -X direction and is longer than the cap holder 102 (see FIG. 2, for example) so as to reach the flushing position H2. During power-off, the flushing box 200 is lifted by the lifting device 260, and is in contact with the bottom surface of the cap holder 102*a* at the cap portion 254. With this, a substantially sealed space AR3 enclosed by the cap portion 254 and the bottom surface of the cap holder 102*a* is formed, and the interior of the tank 252 can be prevented from drying. Thus, ink stored in the tank 252 can be prevented from thickening and adhering to, for example, inner walls of the tank 252. This facilitates maintenance such as cleaning of the interior of the tank 252.

Figure 8:
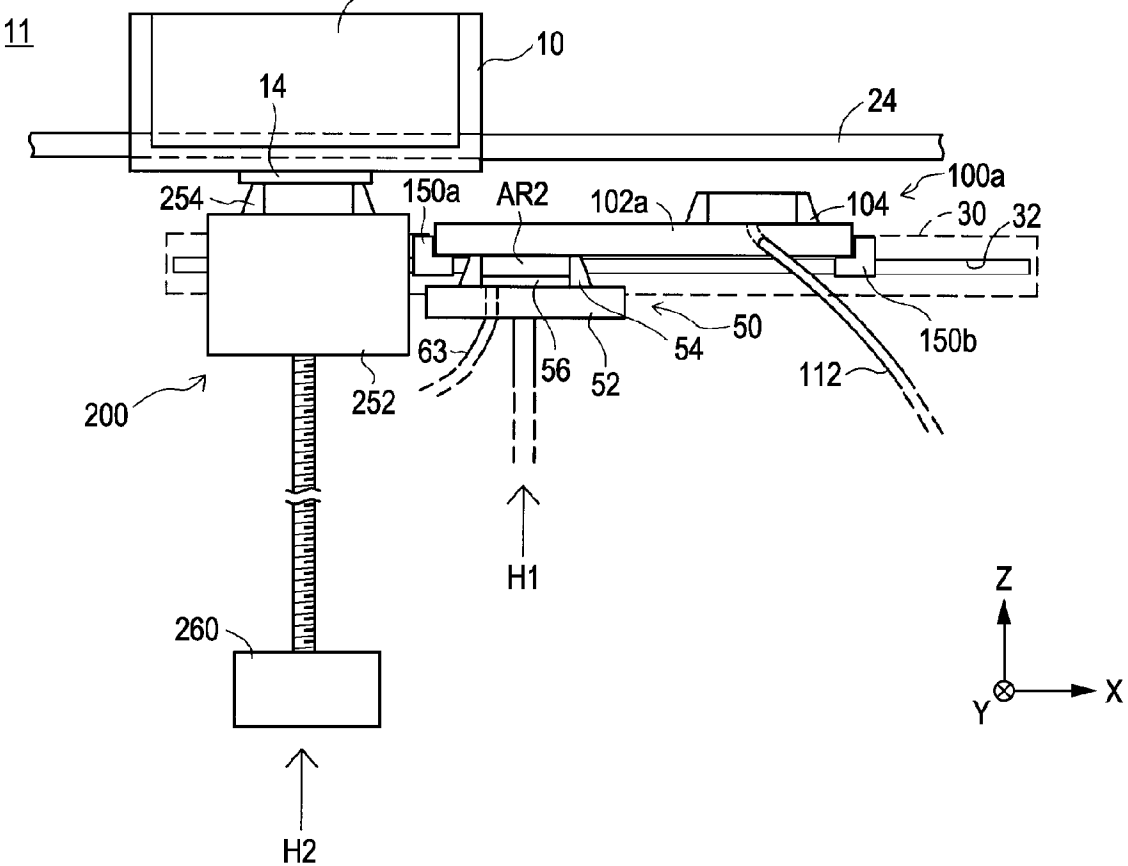
FIG. 8 illustrates a detailed structure in the vicinity of the home position H1 during flushing in Example 2.

FIG. 8 illustrates a detailed structure in the vicinity of the home position H1 during flushing in Example 2. During flushing, the carriage 10 is disposed in the flushing position H2. The third capping device 100*a* is lowered by a length d1 from the state shown in FIG. 7 so as to be supported by the supporting members 150*a* and 150*b*, and moves to the right so as not to prevent the flushing box 200 from being lifted. The flushing box 200 is lifted from the state shown in FIG. 7 by the lifting device 260 so as to be brought into contact with the head 14, and receives ink discharged from the nozzles (not shown) in the head 14. Flushing can be performed, for example, at regular intervals during printing, in response to user instructions while printing is not performed, and immediately after the printer 1000 is turned on.

At this moment, the first capping device 50 is in contact with the bottom surface of the third capping device 100*a* at the cap portion 54, and the space AR2 is formed. Therefore, ink remaining in the sponge 56 inside the cap portion 54 is not dried, and clogging of the sponge 56 can be prevented also during flushing.

As described above, the head 14, the third capping device 100*a*, and the first capping device 50 are also stacked during power-off in Example 2 as in Example 1. Thus, ink remaining in the sponge 56 inside the first capping device 50 is prevented from drying, and clogging of the sponge 56 can be prevented. Moreover, since the flushing box 200 is also in contact with the bottom surface of the third capping device 100*a*, ink remaining inside the flushing box 200 can also be prevented from drying. Furthermore, since the third capping device 100*a* covers the opening of the cap portion 54 using the bottom surface thereof also during flushing, ink remaining in the sponge 56 is prevented from drying, and clogging of the sponge 56 can be prevented.

MODIFICATIONS

Components other than those claimed in the independent claim among those in the above-described examples are additional, and can be omitted as appropriate. Moreover, the invention is not limited to the above-described examples or embodiments, and can be carried out in various modes within the scope of the invention. For example, the following modifications are also possible.

Modification 1

In the above-described examples, only the space AR1 is humidified using the humidifier 110. However, the space AR2 or the space AR3 can be humidified using a humidifier instead of the space AR1 or in addition to the space AR1. In this case, the first capping device 50 or the flushing box 200 can be connected to the humidifier via a tube through which vapor is fed. In this case, the humidifier for humidifying the space AR1 and that for humidifying the space AR2 or the space AR3 can be a common unit, or can be separate units. On the other hand, the spaces AR1 to AR3 are not necessarily humidified using the humidifier 110 in the second capping device 100 and the third capping device 100*a*.

Modification 2

In Example 2, the first capping device 50 and the flushing box 200 are separate components. Instead of this, however, the flushing box 200 can receive ink discharged from the nozzles during suction recovery. As is clear from the above-described examples and the modifications, capping devices that receive ink discharged from the head 14 during preliminary discharge such as suction recovery and flushing can be generally employed in the fluid ejecting apparatus of the invention.

Modification 3

In the above-described examples, the first capping device 50 is in contact with the bottom surface of the cap holder 102 at the cap portion 54 during printing and flushing. However, the first capping device 50 can be in contact with the bottom surface of the cap holder 102 only during power-off. Moreover, the layout of the components during power-off and during the standby mode for printing instructions is not always necessarily the same as those during power-off (stacked states shown in FIGS. 3 and 7). For example, during the standby mode for printing, the components can be stacked for a predetermined period.

Modification 4

In the above-described examples, the head 14 is of the so-called serial type that moves during ink discharge. Instead of the serial type, however, the head can be of the so-called line-head type in which a large number of nozzles are arranged along a width corresponding to the printing area PA. Alternatively, a head unit including a plurality of serial heads can be used. Such a head unit includes, for example, those including a plurality of serial heads arranged in a line orthogonal to a paper feeding direction (X-axis direction in FIG. 1) and those including a plurality of serial heads arranged in a staggered manner.

Modification 5

In the above-described examples, ink is discharged by expansion and contraction of piezoelectric vibrators (not shown) in the nozzles during printing. Instead of the piezoelectric vibrators, heaters can be used.

Modification 6

In the above-described examples, ink-jet printers are described. However, the invention is not limited to this, and can be applied to any fluid ejecting apparatuses that eject fluid (including liquid, liquid bodies in which particles of functional materials are dispersed, and solids capable of being poured or ejected as fluid) other than ink. For example, the invention can also be applied to liquid ejecting apparatuses that eject liquid bodies including materials such as electrode materials and color materials used for producing, for example, liquid-crystal displays, electroluminescent (EL) displays, and surface emitting displays in the form of a dispersion or a solution. Moreover, the invention can be applied to liquid ejecting apparatuses that eject bioorganic substances used for biochip production, liquid ejecting apparatuses used as precision pipettes that eject liquid serving as samples, liquid ejecting apparatuses that eject lubricating oil to precision machines such as watches and cameras with pinpoint accuracy, liquid ejecting apparatuses that eject transparent liquid resin such as ultraviolet curable resin onto substrates so as to form, for example, microscopic hemispherical lenses (optical lenses) used for optical communication elements and the like, liquid ejecting apparatuses that eject acid or alkaline etching reagents so as to etch substrates and the like, and ejecting apparatuses that eject solids such as fine particles including toner.

The entire disclosure of Japanese Patent Application No. 2007-201660, filed Aug. 2, 2007 is expressly incorporated by reference herein.

What is claimed is:

1. A fluid ejecting apparatus for ejecting fluid, comprising:

a head capable of performing effective discharge during which the fluid is discharged to an object to be processed disposed at a predetermined position and capable of preliminary discharge during which the fluid is discharged separately from the effective discharge;

a first head capping unit for preliminary discharge covering the head and receiving the fluid discharged from the head while the head performs the preliminary discharge; and a second head capping unit for moisturizing covering the head and moisturizing the head, wherein the first head capping unit and the second head capping unit are stacked in such a manner that the first capping unit comes into contact with the second capping unit while the second capping unit is in contact with the head and covers the head, such that the second capping unit covers both the head and an opening of the first head capping unit for receiving the fluid while the head does not perform either the effective discharge or the preliminary discharge.

2. The fluid ejecting apparatus according to claim 1, wherein the first head capping unit and the second head capping unit are disposed in such a manner that the opening of the first head capping unit is covered by the second head capping unit while the head performs the effective discharge.

3. The fluid ejecting apparatus according to claim 1, wherein the head discharges the fluid downward while the head performs the effective discharge and the preliminary discharge, the opening of the first head capping unit faces upward, and the second head capping unit covers the head from the bottom of the head, and the first head capping unit is disposed under the second head capping unit and is in contact with the bottom surface of the second head capping unit in such a manner that the opening is covered by the bottom surface while the first head capping unit and the second head capping unit are stacked.

4. The fluid ejecting apparatus according to claim 1, further comprising:

a humidifier, wherein the humidifier humidifies at least one of a first space formed when the second head capping unit covers the head and a second space formed when the second head capping unit covers the opening of the first head capping unit.

5. The fluid ejecting apparatus according to claim 1, wherein the fluid is liquid.

* * * * *